United States Patent [19]

Volz

[11] 3,939,662

[45] Feb. 24, 1976

[54] LIQUID IMPERVIOUS SURFACE STRUCTURES

[75] Inventor: Herbert A. Volz, Bartlesville, Okla.

[73] Assignee: Phillips Petroleum Company, Bartlesville, Okla.

[22] Filed: Dec. 12, 1973

[21] Appl. No.: 426,675

[52] U.S. Cl. ..... 61/1 R; 61/7; 61/36 R; 166/293; 404/72; 427/136

[51] Int. Cl.[2] ..... E02D 3/00; C09J 3/04; E02B 5/02

[58] Field of Search ..... 166/293, 294, 295; 61/36 R, 37, 38, 1 R, 2, 7; 404/72, 75, 76

[56] References Cited

UNITED STATES PATENTS

| | | | |
|---|---|---|---|
| 3,378,070 | 4/1968 | Wessler et al. | 166/294 X |
| 3,383,863 | 5/1968 | Berry | 61/7 |
| 3,421,584 | 1/1969 | Eilers et al. | 166/295 |
| 3,474,625 | 11/1969 | Draper et al. | 61/7 |
| 3,502,149 | 3/1970 | Pence, Jr. | 166/294 |
| 3,555,828 | 1/1971 | Goldstein et al. | 61/1 R |
| 3,611,733 | 10/1971 | Eilers et al. | 166/294 |
| 3,670,506 | 6/1972 | Gaudard | 61/35 |
| 3,727,687 | 4/1973 | Clampitt et al. | 166/274 |
| 3,749,174 | 7/1973 | Friedman et al. | 166/294 |
| 3,762,476 | 10/1973 | Gall | 166/295 |
| 3,867,250 | 2/1975 | Zankowiak et al. | 61/38 |

FOREIGN PATENTS OR APPLICATIONS

| | | | |
|---|---|---|---|
| 4,524,109 | 12/1970 | Japan | 61/1 |

*Primary Examiner*—Jacob Shapiro

[57] ABSTRACT

Liquid impervious surface structures are formed by permeating a fabric and a portion of an earthen foundation with an aqueous gel wherein the permeated earthen foundation is covered by the permeated fabric.

19 Claims, No Drawings

LIQUID IMPERVIOUS SURFACE STRUCTURES

BACKGROUND

The invention relates to a liquid-impervious surface structure and a method for the production of same.

Various materials and methods have been used in the treatment of soil in order to make the soil cohesive and liquid-impervious, and thus possess a number of highly desirable qualities. Such qualities include, among others, the ability to bear high-pressure loads, the ability to withstand penetration by water, and the ability to resist erosion by water or other forces. Earthen reservoirs or ponds represent one example in which it is desirable to have a liquid-impervious surface. Leakage where brine or other fresh water contaminating liquids are stored can be a problem. Earthen dams and canals are also examples of areas in which it is desirable to prevent leakage. Therefore, new soil treatment processes and surface structures which improve the solid state properties of the soil are of continuing interest to the arts in general.

It is an object of the invention to provide a surface structure.

Another object of the invention is to provide a liquid-impervious surface structure.

Still another object of the invention is to provide a liquid-impervious surface structure which is resistant to erosion and puncture, and which has good load bearing qualities.

Yet another object of the invention is to produce a reservoir or pond having a surface which is a liquid-impervious structure.

Other objects, aspects and advantages of the present invention will be obvious to those skilled in the art from a study of the disclosure and the appended claims.

SUMMARY

In accordance with the invention a liquid-impervious surface structure is provided comprising an earthen foundation covered with a fabric wherein both the fabric and a portion of the earthen foundation are permeated with an aqueous gel.

Further according to the invention there is provided a method for the production of a liquid-impervious surface structure comprising permeating a fabric and a portion of an earthen foundation with an aqueous gel, wherein the permeated earthen foundation is covered by the permeated fabric.

DETAILED DESCRIPTION OF THE INVENTION

The earthen foundation suitable for use in the practice of the invention can be any of a variety of soils, regardless of how formed or chemical and physical composition. It is preferred that the earthen foundation be relatively smooth to prevent rupture of the fabric used to cover the foundation; however the present invention retains its liquid-impervious characteristics in spite of such ruptures in the fabric.

A number of fabrics are suitable for use in the practice of the invention. Synthetic fabrics generally resist deterioration and last longer than fabrics made of natural fibers and are preferred. The nonwoven polyolefin fabrics are particularly preferred due to their relatively low cost and availability as well as excellent combination of properties.

A nonwoven polypropylene fabric is well suited for use in the invention. Such fabric can be made from about 2–20 denier, preferably about 3–8 denier, crimped staple of about ½ to about 3 inches in length; a batt of these fibers is needle punched and the needle punched fabric is then passed through a pair of nip rolls, at least one of which is heated above the melting point of the fibers to heat-fuse the fibers on at least one side. The amount of fusion is adjusted to give the final product a tensile strength of from about 10 pounds to about 75 pounds per inch of width, the strength depending upon the amount of fusion, weight of fabric and denier of the fiber. The fabric is ordinarily about 1–5 millimeters thick under no compression. Such fabrics normally come in various lengths, and widths of up to 12 feet. Where a width of greater than 12 feet is required, it is desirable to sew or attach strips of the fabric together to provide one continuous sheet of fabric for better erosion and puncture protection.

The polypropylene fabric should have a weight of at least about 1–4 oz/yd$^2$ but a heavier fabric weighing about 5–6 oz/yd$^2$ can also be used. Much heavier fabrics become uneconomical and heavy to handle.

The aqueous gels suitable for use in the invention are gels formed from water-soluble polymers. Some examples of such water-soluble gel-forming polymers are polyacrylamides, biopolysaccharides and cellulose ethers. These polymers are usually gelled when dissolved in an aqueous medium by contacting the polymers with aqueous solutions of a polyvalent metal and reducing agent. The molecular weight of the polymers employed is not critical; however, the molecular weight must be high enough to enable the polymers to form a gel as hereinafter described, but low enough to allow the polymers to dissolve in water. Other conventional and suitable methods of gelling these polymers well known to those skilled in this art can also be employed.

Various homopolymers and copolymers of acrylamide and methylacrylamide are suitable for use in the invention. The polymers can be at various stages of hydrolysis of the amide groups to carboxyl groups. The method of manufacture of these polymers is well known and not considered a part of this invention.

The biopolysaccharides which can be used in preparing the aqueous gels of the invention include those produced by the action of bacteria of the genus Xanthomonas on carbohydrates. These materials are thus biochemically synthesized polysaccharides and can be referred to as biopolysaccharides to distinguish them from naturally-occurring polysaccharides. It has been shown in the prior art that biopolysaccharides are produced with particular efficiency by certain species of the Xanthomonas genus and are thus preferred. These preferred species include Xanthomonas begoniae, Xanthomonas campestris, Xanthomonas incanae, and Xanthomonas pisi.

A wide variety of carbohydrates can be fermented with bacteria of the genus Xanthomonas to produce said biopolysaccharides. Suitable carbohydrates include sucrose, glucose, maltose, fructose, lactose, galactose, soluble starch, corn starch, potato starch, and the like. The prior art has also shown that the carbohydrates need not be in a highly refined state and that crude materials from natural sources can be utilized. Examples of such suitable natural source materials include crude molasses, raw sugar, raw potato starch, sugar beet juice, and the like. Since they are much less expensive than the corresponding refined carbohydrates, such natural source materials are usually preferred for use as the substrate in preparing said biopolysaccharides. Fermentation of the carbohydrate to produce said biopolysaccharides is well known and not considered a part of the present invention.

In general, any water-soluble cellulose ether or mixtures thereof can be employed in the practice of this invention. Such cellulose ethers or ether mixtures can include, among others: the various carboxyalkyl cellulose ethers, e.g., carboxyethyl cellulose and carboxymethyl cellulose (CMC); mixed ethers such as carboxyalkyl hydroxyalkyl ethers, e.g., carboxymethyl hydroxyethyl cellulose (CMHEC); hydroxyalkyl celluloses such as hydroxyethyl cellulose, and hydroxypropyl cellulose; alkylhydroxyalkyl celluloses such as methylhydroxypropyl cellulose; alkyl celluloses such as methyl cellulose, ethyl cellulose, and propyl cellulose; alkylcarboxyalkyl celluloses such as ethylcarboxymethyl cellulose; alkylalkyl celluloses such as methylethyl cellulose; and hydroxyalkylalkyl celluloses such as hydroxypropylmethyl cellulose; and the like. Many of said cellulose ethers are available commercially in various grades. The carboxy-substituted cellulose ethers are available as the alkali metal salt, usually the sodium salt. However, the metal is seldom referred to, and the salts are commonly referred to as CMC, CMHEC, etc. For example, water-soluble CMC is available in various degrees of carboxylate substitution ranging from about 0.3 up to the maximum degree of substitution of 3. In general, CMC having a degree of substitution in the range of about 0.65 to about 0.95 is preferred. Frequently, CMC having a degree of substitution in the range of about 0.85 to about 0.95 is a more preferred cellulose ether. CMC having a degree of substitution less than the above preferred ranges is usually less uniform in properties and thus less desirable for use in the practice of the invention. CMC having a degree of substitution greater than the above preferred ranges usually has a lower viscosity and more is required in the practice of the invention. The degree of substitution of CMC is commonly designated in practice as CMC-7, CMC-9, CMC-12, etc., where the 7, 9 and 12 refer to a degree of substitution of 0.7, 0.9 and 1.2, respectively.

In the above-described mixed ethers, it is preferred that the portion thereof which contains the carboxylate groups be substantial instead of a mere trace. For example, in CMHEC it is preferred that the carboxymethyl degree of substitution be at least about 0.4. The degree of hydroxyethyl substitution is less important and can vary widely, e.g., from about 0.1 or lower to about 4 or higher. The method of manufacture of these polymers is also well known and not considered a part of the present invention.

The amount of such polymers used in the practice of the invention can vary widely depending upon the particular polymer used, the purity of the polymer and properties desired in the resulting gel. In general, the amount of the polymer used in preparing the aqueous solutions will be a water-thickening amount, i.e., at least an amount which, prior to gelation as herein described, will significantly thicken the water to which it is added. Generally speaking, amounts in the range of 0.0025 to 5, preferably 0.01 to 1.5, weight percent based on the weight of water, can be used in the practice of the invention. However, it is within the scope of the invention to use amounts outside these ranges.

The reducible polyvalent metal compounds which can be used in the practice of this invention are water-soluble compounds of polyvalent metals wherein the metal is present in a valence state which is capable of being reduced to a lower polyvalent valence state. Examples of such compounds include potassium permanganate, sodium permanganate, ammonium chromate, ammonium dichromate, the alkali metal chromates, the alkali metal dichromates, and chromium trioxide. Sodium dichromate and potassium dichromate, because of low cost and ready availability, are the presently preferred metal compounds for use in the practice of the invention.

The amount of the reducible polyvalent metal compounds used in the practice of the invention will be a sensible amount, i.e., a small but finite amount which is more than incidental impurities and which is effective or sufficient to cause subsequent gelation of water-soluble cellulose ether in the presence of water, when the metal in the polyvalent metal compound is reduced to a lower polyvalent valence state. The lower limit of concentration of the starting metal compound will be dependent upon several factors, including the particular type of polymer used, the concentration of the polymer in the aqueous medium to be gelled, and the type of gelled product desired. For similar reasons, the upper limit on the concentration of the starting metal compound also cannot always be precisely defined. However, it should be noted that excessive amounts of the starting metal compound can adversely affect the stability of the gels produced. As a general guide, the amount of the starting polyvalent metal compound used in preparing aqueous gels in accordance with the invention will be in the range of from about 0.025 to about 100, preferably from about 0.5 to about 40, weight percent of the amount of the polymer used.

Suitable water-soluble reducing agents which can be used in the practice of this invention include sulfur-containing compounds such as sodium sulfate, sodium hydrosulfite, sodium metabisulfite, potassium sulfite, sodium bisulfite, potassium metabisulfite, sodium sulfide, sodium thiosulfate, ferrous sulfate, and thioacetamide; and nonsulfur-containing compounds such as hydroquinone, ferrous chloride, p-hydrazinobenzoic acid, hydrazine phosphite, hydrazine dichloride, and mixtures thereof.

The amount of reducing agent to be used in the practice of the invention will be a sensible amount, i.e., a small but finite amount which is more than incidental impurities and which is effective or sufficient to reduce at least a portion of the higher valence metal in the starting polyvalent metal compound to a lower polyvalent valence state. Thus, the amount of reducing agent to be used depends, to some extent at least, upon the amount of the starting polyvalent metal compound which is used. In many instances, it will be preferred to use an excess of reducing agent to compensate for dissolved oxygen in the water, exposure to air during preparation of the gels, or any other possible contact with oxidizing substances such as might be encountered in said treating operations. As a general guide, the amount of reducing agent used will generally be within the range of from about 0.1 to about 300, preferably within the range of from about 1.0 to about 200, weight percent of the stoichiometric amount required to reduce the metal in the starting polyvalent metal compound to said lower valence state. However, in some instances, it may be desirable to use amounts of reducing agent outside the ranges, which use of such amounts is also within the scope of the invention. Those skilled in the art can determine the amount of reducing agent to be used by simple experiments carried out in the light of this disclosure.

Various methods can be used for preparing the aqueous solutions employed in the practice of this invention. For example, either the reducible polyvalent metal compound or the reducing agent can be added separately to a solution of the polymer in water or other aqueous medium, or the reducible polyvalent metal compound and the reducing agent can be added simultaneously to the solution or aqueous medium containing the polymer. Generally speaking, where convenient, the preferred method is to first disperse the polymer in the water or other aqueous medium. The reducing agent is then added to the polymer solution with stirring. The metal compound is added to the solution or aqueous medium containing the polymer and the reducing agent, with stirring. Gelation starts as soon as some of the higher valence metal in the starting polyvalent metal compound is reduced to the lower valence state. The newly formed lower valence metal ions effect rapid gelation of the solution or aqueous medium containing the polymer.

If desired, finely divided material such as silica flour, diatomaceous earth, ground nut shells, natural sands, clay, or clay-like materials such as illite and kaolinite clay, and finely divided plastic material, such as powdered polyethylene resins, can also be incorporated into the aqueous gel-forming solutions in order to increase the firmness of the gel. When such filler agents are used, the amounts will generally range from about 0.05 to 2 pounds per gallon of solution. Usually the micron size will vary from about 0.015 to 420. The filler agents can be added to the gel-forming solution in any suitable manner and at any time.

It is within the scope of this invention to prepare a dry mixture of the polymer, the reducible polyvalent metal compound and the reducing agent, in proper proportions, and then add this dry mixture to the proper amount of water in order to form an aqueous gel suited to the practice of this invention.

Generally the gel-forming solutions prepared as described above are then contacted with the fabric previously described by a suitable method, such as spraying; however, the soil-treating liquid need not be applied as a single liquid. For example, the application can comprise contacting the soil consecutively with the same or different solutions. Thus, the earthen foundation covered with fabric can first be contacted with a solution of the gel-forming polymer in admixture with the polyvalent metal salt. This can be followed by contact with another solution containing the reducing agent. Similarly, a first solution can comprise the gel-forming polymer and the reducing agent while the second solution contains the polyvalent metal salt or alternatively separate solutions of the polymer, polyvalent metal salt and the reducing agent can be used. The order of addition of such multiple solutions can also be varied.

The aqueous polymeric solutions of the present invention can be applied to the surfaces to be treated at a rate of about 0.5 to about 5, more generally about 1 to about 3, gallons per square yard. The application rate will depend, of course, upon the concentration of the active ingredients in the treating liquid and upon the nature of the surface. The polymeric solutions as well as the polyvalent metal and reducing agent solutions can be applied in more than one application, with any amount of waiting time between applications. The amount of the polyvalent metal and reducing agent solutions required if not admixed with the polymeric solution is determined as previously discussed.

An advantage of this invention is that ordinary ambient temperatures can be used in practically all instances in preparing the aqueous gels of the invention or aqueous medium containing same. In some instances, however, a small amount of heat may be desirable to aid in the formation of the gel, e.g., heating of the aqueous medium to a temperature of about 40° to about 130°F.

It is also pointed out that it is within the scope of the invention to treat the earthen foundation with the gel-forming solutions before covering the earthen foundation with the fabric. Where that is done it is desirable to treat the soil just prior to laying the fabric with a solution in which gelation has occurred such that sufficient gel remains on top of the earthen foundation to permeate the fabric. However, in the preferred embodiment the fabric is placed over the earthen foundation first; then the above-described solutions are sprayed or applied in any suitable method over the fabric, thus producing a gel which permeates both the fabric and a portion of the earthen foundation.

What is claimed is:

1. A liquid-impervious surface structure comprising an earthen foundation covered with a fabric wherein said fabric and a portion of said earthen foundation are permeated with an aqueous gel formed from a water-soluble polymer.

2. The liquid-impervious surface structure of claim 1 wherein the fabric is a nonwoven polyolefin material.

3. The liquid-impervious surface structure of claim 2 wherein the polyolefin is polypropylene.

4. The liquid impervious surface structure of claim 1 wherein the aqueous gel comprises:

water;

a water-thickening amount of a water-soluble gel-forming polymer;

a water-soluble polyvalent metal compound in an amount sufficient to gel the gel-forming polymer when the valence of at least a portion of the polyvalent metal is reduced to a lower valence state; and a water-soluble reducing agent in an amount sufficient to reduce at least a portion of the polyvalent metal to the lower valence state.

5. The liquid-impervious surface structure of claim 4 wherein the amount of the gel-forming solution is in the range of from about 0.5 to 5 gallons per square yard of surface to be treated, the amount of the gel-forming polymer is in the range of from about 0.0025 to 5 weight percent based on the weight of the water, the amount of the reducible polyvalent metal compound is in the range of from about 0.025 to 100 weight percent based on the weight of the gel-forming polymer and the amount of the reducing agent is in the range of from about 0.1 to 300 weight percent of the stoichiometric amount of the reducing agent required to reduce the polyvalent metal to the lower valence state.

6. The liquid-impervious surface structure of claim 5 wherein the amount of the gel-forming solution is in the range of from about 1 to 3 gallons per square yard of surface to be treated, the amount of the gel-forming polymer is in the range of from about 0.01 to 1.5 weight percent based on the weight of the water, the amount of the reducible polyvalent metal compound is in the range of from about 0.5 to 40 weight percent based on the weight of the gel-forming polymer and the amount of the reducing agent is in the range of from about 1 to 200 weight percent of the stoichiometric amount of the reducing agent required to reduce the polyvalent metal to the lower valence state.

7. The liquid-impervious surface structure of claim 6 wherein the gel-forming polymer is selected from the group-consisting of cellulose ethers, biopolysaccharides and polyacrylamides, wherein the polyvalent metal compound is selected from the group consisting of ammonium chromate, ammonium dichromate, the alkali metal chromates and dichromates, chromium trioxide, and mixtures thereof, and wherein the reducing agent is selected from the group consisting of hydroquinone, sodium sulfide, sodium hydrosulfite, sodium metabisulfite, potassium sulfite, sodium bisulfite, potassium metabisulfite, sodium sulfite, sodium thiosulfate, ferrous sulfate, ferrous chloride, p-hydrazinobenzoic acid, hydrazine phosphite, hydrazine dihydrochloride, and mixtures thereof.

8. The liquid-impervious surface structure of claim 4 wherein the gel-forming polymer is selected from the group consisting of carboxymethyl cellulose, and the biopolysaccharide produced by the action of bacteria of the genus Xanthomonas campestris on a carbohydrate; the polyvalent metal compound is sodium dichromate; and the reducing agent is sodium hydrosulfite.

9. The liquid-impervious surface structure of claim 4 wherein the gel-forming polymer is a biopolysaccharide, wherein the polyvalent metal compound is selected from the group consisting of ammonium chromate, ammonium dichromate, the alkali metal chromates and dichromates, chromium trioxide, and mixtures therof, and wherein the reducing agent is selected from the group consisting of hydroquinone, sodium sulfide, sodium hydrosulfite, sodium metabisulfite, potassium sulfite, sodium bisulfite, potassium metabisulfite, sodium sulfite, sodium thiosulfate, ferrous sulfate, ferrous chloride, p-hydrazinobenzoic acid, hydrazine phosphite, hydrazine dihydrochloride, and mixtures thereof.

10. A method for the production of a liquid-impervious surface structure which comprises:

permeating a fabric and a portion of an earthen foundation with an aqueous gel formed from a water-soluble polymer, wherein said permeated earthen foundation is covered by said permeated fabric.

11. The method of claim 10 wherein the earthen foundation defines an earthen reservoir.

12. The method of claim 10 wherein the fabric is a nonwoven polyolefin material.

13. The method of claim 12 wherein the polyolefin is polypropylene.

14. The method of claim 10 wherein the permeation step comprises contacting the fabric and at least a portion of the earthen foundation with aqueous solutions of a gel-forming polymer, a reducible polyvalent metal compound and a reducing agent wherein;

the gel-forming polymer solution comprises at least water and a water-thickening amount of the water-soluble gel-forming polymer;

the reducible polyvalent metal compound solution comprises at least water and an amount of the polyvalent metal compound sufficient to gel the gel-forming polymer solution when the valence of at least a portion of the polyvalent metal is reduced to a lower valence state; and the reducing agent solution comprises at least water and an amount of the reducing agent sufficient to reduce at least a portion of the polyvalent metal to the lower valence state.

15. The method of claim 14 wherein the amount of the gel-forming solution is in the range of from about 0.5 to 5 gallons per square yard of surface to be treated, the amount of the gel-forming polymer is in the range of from about 0.0025 to 5 weight percent based on the weight of the water, the amount of the reducible polyvalent metal compound is in the range of from about 0.025 to 100 weight percent based on the weight of the gel-forming polymer and the amount of the reducing agent is in the range of from about 0.1 to 300 weight percent of the stoichiometric amount of the reducing agent required to reduce the polyvalent metal to the lower valence state.

16. The method of claim 15 wherein the amount of the gel-forming solution is in the range of from about 1 to 3 gallons per square yard of surface to be treated, the amount of the gel-forming polymer is in the range of from about 0.01 to 1.5 weight percent based on the weight of the water, the amount of the reducible polyvalent metal compound is in the range of from about 0.5 to 40 weight percent based on the weight of the gel-forming polymer and the amount of the reducing agent is in the range of from about 1 to 200 weight percent of the stoichiometric amount of the reducing agent required to reduce the polyvalent metal to the lower valence state.

17. The method of claim 16 wherein the gel-forming polymer is selected from the group consisting of cellulose ethers, biopolysaccharides and polyacrylamides, wherein the polyvalent metal compound is selected from the group consisting of ammonium chromate, ammonium dichromate, the alkali metal chromates and dichromates, chromium trioxide, and mixtures thereof, and wherein the reducing agent is selected from the group consisting of hydroquinone, sodium sulfide, sodium hydrosulfite, sodium metabisulfite, potassium sulfite, sodium bisulfite, potassium metabisulfite, sodium sulfite, sodium thiosulfate, ferrous sulfate, ferrous chloride, p-hydrazinobenzoic acid, hydrazine phosphite, hydrazine dihydrochloride, and mixtures thereof.

18. The method of claim 14 wherein the gel-forming polymer is selected from the group consisting of carboxymethyl cellulose, and the biopolysaccharide produced by the action of bacteria of the genus Xanthomonas campestris on a carbohydrate; the polyvalent metal compound is sodium dichromate; and the reducing agent is sodium hydrosulfite.

19. The method of claim 14 wherein the gel-forming polymer is a biopolysaccharide, wherein the polyvalent metal compound is selected from the group consisting of ammonium chromate, ammonium dichromate, the alkali metal chromates and dichromates, chromium trioxide, and mixtures thereof, and wherein the reducing agent is selected from the group consisting of hydroquinone, sodium sulfide, sodium hydrosulfite, sodium metabisulfite, potassium sulfite, sodium bisulfite, potassium metabisulfite, sodium sulfite, sodium thiosulfate, ferrous sulfate, ferrous chloride, p-hydrazinobenzoic acid, hydrazine phosphite, hydrazine dihydrochloride, and mixtures thereof.

* * * * *